US008910622B2

(12) United States Patent
Mishra et al.

(10) Patent No.: US 8,910,622 B2
(45) Date of Patent: Dec. 16, 2014

(54) HINGED COOKTOP GRIDS

(75) Inventors: Nirmal Kumar Mishra, Pune (IN); Prashant Ruperee, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 955 days.

(21) Appl. No.: 12/618,169

(22) Filed: Nov. 13, 2009

(65) Prior Publication Data

US 2011/0114077 A1 May 19, 2011

(51) Int. Cl.
*F24C 3/08* (2006.01)
*F24C 15/10* (2006.01)

(52) U.S. Cl.
CPC ..... *F24C 15/107* (2013.01)
USPC ..... 126/39 R; 126/39 J; 126/214 A; 126/212; 219/453.12

(58) Field of Classification Search
USPC ..... 126/39 R, 39 J, 214 A, 212, 214 C, 211, 126/41 R, 41 A; 219/453.14, 452.13; 99/423, 425
See application file for complete search history.

(56) References Cited

U.S. PATENT DOCUMENTS

| | | | | | |
|---|---|---|---|---|---|
| 2,370,595 | A | * | 2/1945 | Volks | 99/423 |
| 2,751,487 | A | * | 6/1956 | Vallorani et al. | 219/453.14 |
| 2,994,317 | A | * | 8/1961 | More | 126/211 |
| 3,017,490 | A | * | 1/1962 | McOrlly et al. | 219/453.14 |
| 3,065,327 | A | * | 11/1962 | Coultrip | 219/449.1 |
| 3,238,486 | A | * | 3/1966 | Mertler | 338/25 |
| 3,482,079 | A | * | 12/1969 | Hurko | 219/453.14 |
| 3,553,427 | A | * | 1/1971 | Filipak | 219/453.14 |
| 3,586,826 | A | * | 6/1971 | Dills | 219/454.12 |
| 3,645,249 | A | | 2/1972 | Henderson et al. | |
| 3,773,027 | A | * | 11/1973 | Dodd | 126/39 J |
| 5,495,845 | A | * | 3/1996 | Hait | 126/9 R |
| 6,399,924 | B1 | | 6/2002 | Cai | |
| 2003/0051724 | A1 | * | 3/2003 | Rummel et al. | 126/211 |

FOREIGN PATENT DOCUMENTS

GB 849660 A 9/1960

* cited by examiner

*Primary Examiner* — Avinash Savani

(57) ABSTRACT

A cooking appliance includes a cooktop with a number of gas burners positioned below a grate. The grate is hinged to the cooktop so as to be pivotable between a raised position and a lowered position.

17 Claims, 7 Drawing Sheets

HINGED COOKTOP GRIDS

TECHNICAL FIELD

The present disclosure relates generally to gas cooking ranges having gas burners and more particularly to gas cooking ranges with cook top grates that support cooking vessels over the gas burners.

BACKGROUND

A gas cooking range is used to cook foodstuffs on a cooking surface. The range uses natural gas or propane fuel to create a flame to generate heat for cooking. Metal grids or grills form a cooking surface to support cooking vessels over an open flame created by a burner on the range.

SUMMARY

According to one aspect, a cooking appliance is disclosed. The cooking appliance includes a cooktop surface and a first gas burner extending from the cooktop surface. The cooking appliance also includes a grate forming a cooking surface for supporting a cooking vessel, and a hinge assembly coupled to the cooktop surface and the grate to allow the grate to pivot relative to the cooktop surface between a lowered position and a raised position.

The hinge assembly may include a yoke and a pivot pin engaged with the yoke. The pivot pin may be engaged such that there is relative movement between the yoke and the pivot pin during movement of the grate between the lowered and raised positions.

The cooking appliance may further include a second gas burner extending from the cooktop surface. The grate may overly both the first and second burners when the grate is in the lowered position.

The hinge assembly may further include a pivot arm and the pivot pin may be secured to an end of the pivot arm. The grate may rest against the pivot arm when the grate is positioned in the raised position.

The pivot axis of the grate may be positioned between the cooking surface and the cooktop surface. The pivot axis of the grate may be generally parallel to the cooking surface and the cooktop surface.

Service access to the first burner may be permitted when the grate is positioned in the raised position. Service access to the first burner may be prevented when the grate is positioned in the lowered position.

In another aspect of the disclosure, a cooking appliance includes a cooktop having a gas burner and a grate forming a cooking surface that is configured to support a cooking vessel at a position above the gas burner. The cooking appliance also includes a hinge assembly coupled to the cooktop and the grate to allow the grate to pivot relative to the cooktop between a lowered position and a raised position.

The hinge assembly may include a yoke secured to the grate and a pivot pin secured to the cooktop. The pivot pin may be received within the yoke to allow the yoke to pivot relative to the pivot pin. In some embodiments, the pivot pin may be received within the yoke to allow the pin to pivot relative to the yoke.

The cooking appliance may further include a support post secured to a first side of the grate. The support post may support the first side of the grate when the grate is positioned in the lowered position. The hinge assembly may be secured to a second, opposite side of the grate to support the second side of the grate when the grate is positioned in the lowered position.

In some embodiments, a support post may be secured to the cooktop. The hinge assembly may be secured to a first side of the grate to support the first side of the grate when the grate is positioned in the lowered position. The support post may support a second, opposite side of the grate when the grate is positioned in the lowered position.

The cooking appliance may include a burner pan. The gas burner may be positioned in the burner pan. Service access to the burner may be permitted when the grate is positioned in the raised position. Service access to the burner may be prevented when the grate is positioned in the lowered position.

In another aspect of the disclosure, a cooking appliance includes a cooktop having a first gas burner positioned proximate to the front of the cook top and a second gas burner positioned proximate to the rear of the cooktop. The cooking appliance further includes a grate having a frame with a number of tines extending inwardly from the frame. The tines form a first cooking surface configured to support a first cooking vessel above the first gas burner. The tines also form a second cooking surface configured to support a second cooking vessel above the second gas burner. The cooking appliance also includes a hinge assembly coupled to the cooktop and the grate to allow the grate to pivot relative to the cooktop between a lowered position and a raised position.

The hinge assembly may include a yoke secured to the grate and a pivot pin secured to the cooktop. The pivot pin may be received within the yoke to allow the yoke to pivot relative to the pivot pin.

In some embodiments, the hinge assembly may include a yoke secured to the cooktop and a pivot pin secured to the grate. The pivot pin may be received within the yoke to allow the pin to pivot relative to the yoke.

The cooking appliance may further include a support post secured to a first side of the grate. The support post may support the first side of the grate when the grate is positioned in the lowered position. The hinge assembly may be secured to a second, opposite side of the grate to support the second side of the grate when the grate is positioned in the lowered position. In some embodiments, the hinge assembly may be secured to a first side of the grate to support the first side of the grate when the grate is positioned in the lowered position and the support post may support a second, opposite side of the grate when the grate is positioned in the lowered position.

The cooktop may include a burner pan. The first gas burner and the second gas burner may be positioned in the burner pan. Service access to both the first burner and the second burner may be permitted when the grate is positioned in the raised position. Service access to both the first burner and the second burner may be prevented when the grate is positioned in the lowered position.

BRIEF DESCRIPTION OF THE DRAWINGS

The detailed description particularly refers to the following figures, in which.

DETAILED DESCRIPTION OF THE DRAWINGS

Figure 1:
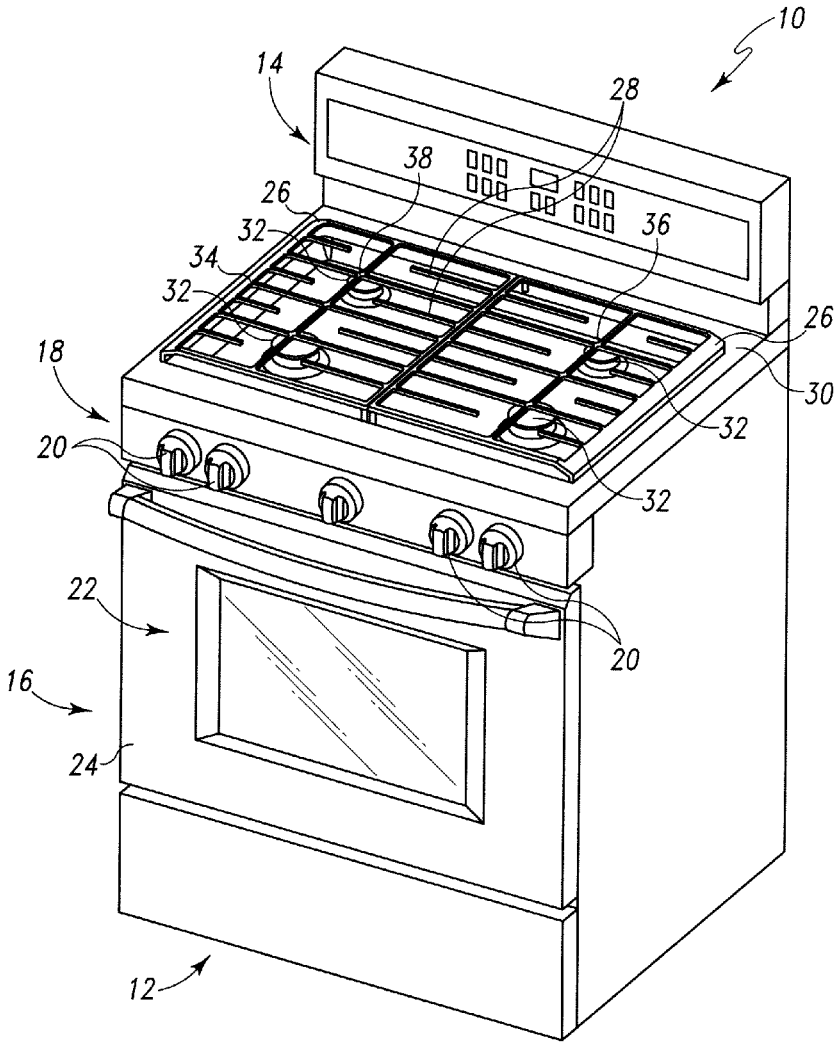
FIG. 1 is a perspective view of a gas cooking range.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the invention is to cover all modifications, equivalents, and alternatives falling within the spirit and scope of the invention as defined by the appended claims.

Referring to FIG. 1, a gas cooking range assembly 10 (hereinafter range 10) includes a lower frame 12 and an upper housing 16 which extends upwardly from the lower frame 12. An upper control panel 14 is secured to the upper housing 16. The upper housing 16 encloses an oven 22 that is covered by a hinged door assembly 24 which is movable relative to the upper housing 16 to permit access to the oven 22. The oven has a cooking chamber (not shown) into which pans, sheets, or other cooking vessels are placed to be heated. The oven 22 has a cooking element (not shown) that is configured to provide heat for baking or otherwise cooking food items placed in the cooking chamber.

A cooktop 30 is positioned above the oven 22. The cooktop 30 includes a number of gas burners 32. A pair of grates 34, 36 is supported on the cooktop 30 with the grates 34, 36 cooperating to define a cooking surface 38 for supporting cooking vessels (e.g., pots and pans) above the gas burners 32. In the illustrative embodiment, the grates 34, 36 are made of cast iron with the grate 34 positioned on the left side and the grate 36 positioned on the right side of the cooktop 30. The design of the two grates 34, 36 is in essence the same, with the only difference being the hand of the respective grates 34, 36.

Each of the gas burners 32 is controlled by a corresponding knob 20 positioned on a lower control panel 18 on the front of the upper housing 16. Each knob 20 controls the flow of gas to a respective gas burner 32 to control the flame and, thereby, heat generated by the gas burner 32. The heat generated by the gas burners 32 is used to heat cooking vessels (e.g., pots and pans) placed on the cooking surface 38. The gas burners 32 may be operated individually such that multiple vessels may be heated at the same time on the cooking surface 38.

Figure 2:
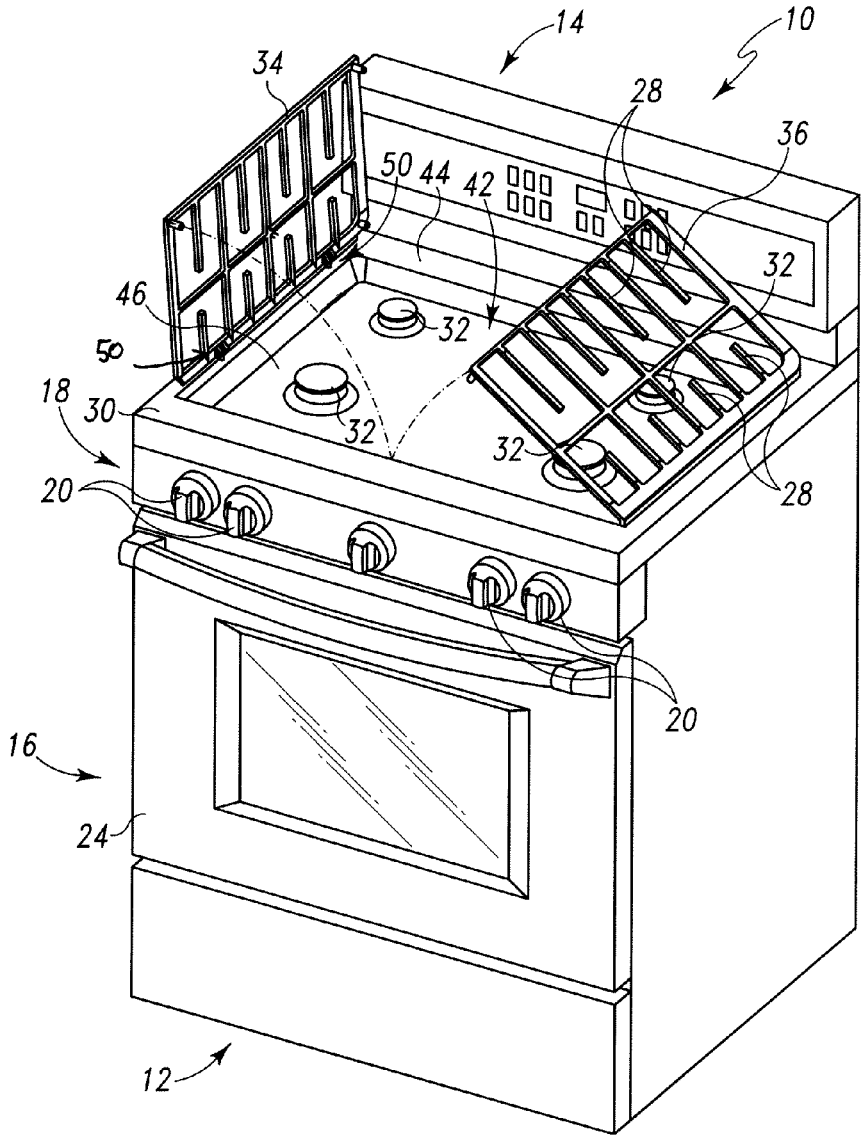
FIG. 2 is a perspective view of the gas cooking range of FIG. 1 with the grates which form a cooking surface pivoted to expose gas burners of the range as well as a surface supporting the gas burners.

Referring now to FIG. 2, the left grate 34 is shown in a fully raised position, with the right grate 36 being shown in a partially raised position. In the illustrative embodiment described herein, the cooktop 30 includes a burner pan 42 in the form of a surface 46 which is recessed from the cooktop's upper surface 44. The gas burners 32 are positioned in the burner pan 42. In such a way, the grates 34, 36 are positioned above the gas burners 32. Because the grates 34, 36 are pivotable relative to the cooktop 30, a user may move the grates 34, 36 between their respective lowered positions shown in FIG. 1 (i.e., the position used for cooking) and raised positions (as shown in FIG. 2), to permit service access by a user to clean the burners and/or the burner pan. For example, scraps which fall and fluids which spill during cooking are collected in the burner pan 42. For cleaning, service access to the area under the grates 34, 36 is permitted by pivoting the grates 34, 36 and without the need for removing the grates 34, 36 from the range 10. What is meant herein by the term "service access" is access to the burner pan (and hence the gas burners) through a gap between the grate and the cooktop formed by raising one side of the grate relative to the cooktop to allow for cleaning or servicing of the burner pan and/or the gas burners. Hence, "service access" is distinct from, for example, a situation where a user merely extends his or her fingers between the tines of the grates to wipe the burner pan or the burner since such access was not through the gap between the cooktop and the grate formed by raising the grate. In short, service access to the burner pan and/or the burners is permitted when one or more of the grates 34, 36 is positioned in a fully-raised or partially-raised position (e.g., the positions shown in FIG. 2), whereas service access to the burner pan and/or the burners is prevented when a given grate 34, 36 is positioned in the lowered position (i.e., the position used for cooking shown in FIG. 1)

The grates 34, 36 are also exposed to soiling by spills and falling scraps. Pivoting of the grates 34, 36, rather than removal of the grates 34, 36 from the cooktop 30, avoids the potential for spreading the scraps and other soiling to other surfaces in the kitchen. In addition, pivoting of the grates 34, 36 reduces the load a user must bear in moving the grates 34, 36 during cleaning of the cooktop 30 as a portion of the weight of the grates 34, 36 is supported when the grates 34, 36 are pivoted.

Figure 3:
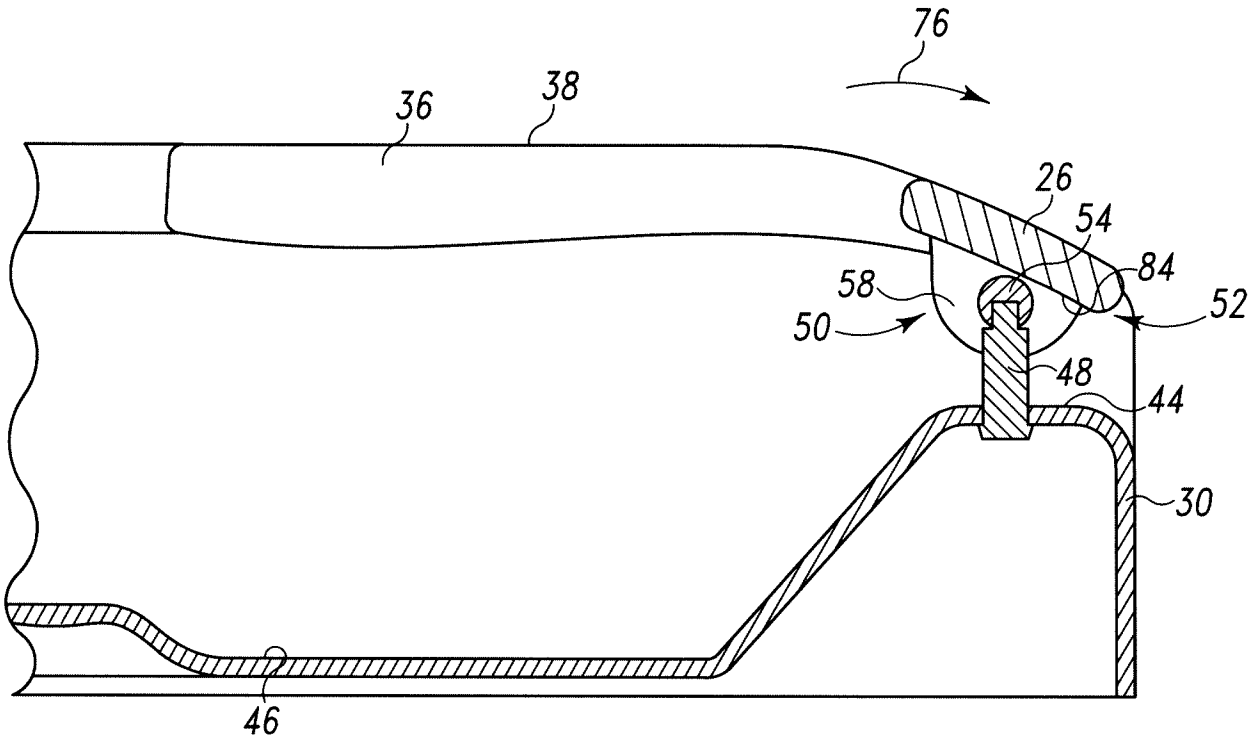
FIG. 3 is a cross-sectional view of a portion of the gas cooking range of FIG. 1.

Referring now to FIG. 3, the grates 34, 36 include an outer frame 26 with a number of support tines 28 extending therefrom. The grates 34, 36 are hinged to the upper surface 44 of the cooktop 30 by two hinge assemblies 50. As can be seen in FIG. 2, one of the hinge assemblies 50 is located near the front of the grate 34, 36, with the other being located near the rear of the grate 34, 36. Each of the hinge assemblies 50 includes a yoke 52 having a pivot pin 54 extending therethrough. In the illustrative embodiment described herein, the yoke 52 is embodied as a pair of spaced apart flanges 56, 58 (see FIGS. 3 and 4) that are welded or otherwise secured to the frame 26 of the grate 34, 36. Holes are formed in each of the flanges 56, 58, with the pivot pin 54 being positioned in such holes. As can be seen in FIG. 3, the pivot pin 54 is non-movably secured to a pivot arm 48 that extends upwardly from the upper surface 44 of the cooktop 30. In the illustrative embodiment described herein, the distal end of the pivot arm 48 is received into a recess formed in the pivot pin 54.

In such an arrangement, the flanges 56, 58 of the yokes 52 are movable relative to the pivot pin 54. That is, the yokes 52, and hence the grates 34, 36, are free to pivot relative the pivot pin 54 and hence the cooktop 30.

Figure 4:
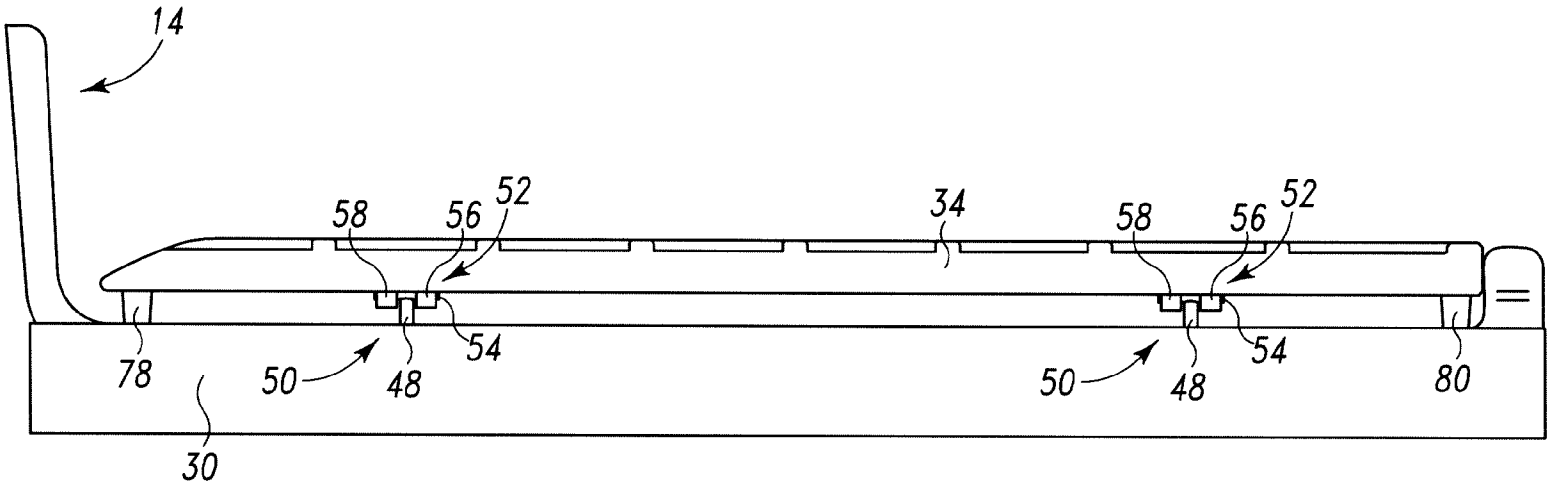
FIG. 4 is a side view of a portion of the gas cooking range of FIG. 1.

Referring now to FIG. 4, the grates 34, 36 each further include a pair of support posts 78, 80 which support the grates 34, 36 when the grates are positioned in their lowered positions (i.e., the positions shown in FIG. 1. The support post 78 is positioned at the rear of the grate 34 near the upper panel 14. The support post 78 underlies the frame 26 and engages the upper surface 44 of the cooktop 30. The support post 80 is positioned along the front side of the grate 34 and likewise engages the upper surface 44 of the cooktop 30 when the grate 34 is in the lowered position. Thus, when positioned in their lowered positions (i.e., the position of FIG. 1), the grates 34, 36 are supported on one side by the hinge assemblies 50 and by the support posts 78, 80 on the other side. When positioned in the raised position, the grates 34, 36 are supported by the hinge assemblies 50.

As described in detail above, when the grates 34, 36 are raised, the yokes 52 move (i.e., pivot) relative to the stationary pivot pins 54. In such a raised position, the load (i.e., the weight) of the grates 34, 36 is borne through the hinge assemblies 50. As shown in FIG. 3, when the grate 36 is raised (i.e., pivoted about the pivot pin 54 in the direction of arrow 76), the frame 26 moves into a position in which its underside surface 84 rests against the pivot arm 48 of the hinge assemblies 50. In such a way, the pivot arms 48 function as stops to prevent the grate 36 from being over rotated beyond a position just slightly past vertical. In such a way, the grate 36 is maintained in its raised position while providing access to the burner pan 42.

The left grate 34 functions in the same way and is shown in a fully raised position in FIG. 2, with the underside surface 84 of the frame 26 of the grate 34 resting against the pivot arms 48. It should be noted that the pivot axis of the grates 34, 36 are coincident with the centers of the respective pivot pins 54. The pivot pins 54 are positioned between the upper surface 44 of the cooktop 30 and the cooking surface 38 of the grates 34, 36 so that there is clearance for the portions of the frames 26 that extend beyond the hinge assemblies 50. This arrangement provides clearance to allow the grates 34, 36 to rotate about the pivot pins 54 without impinging on the upper surface 44 of the cooktop 30.

Figure 5:
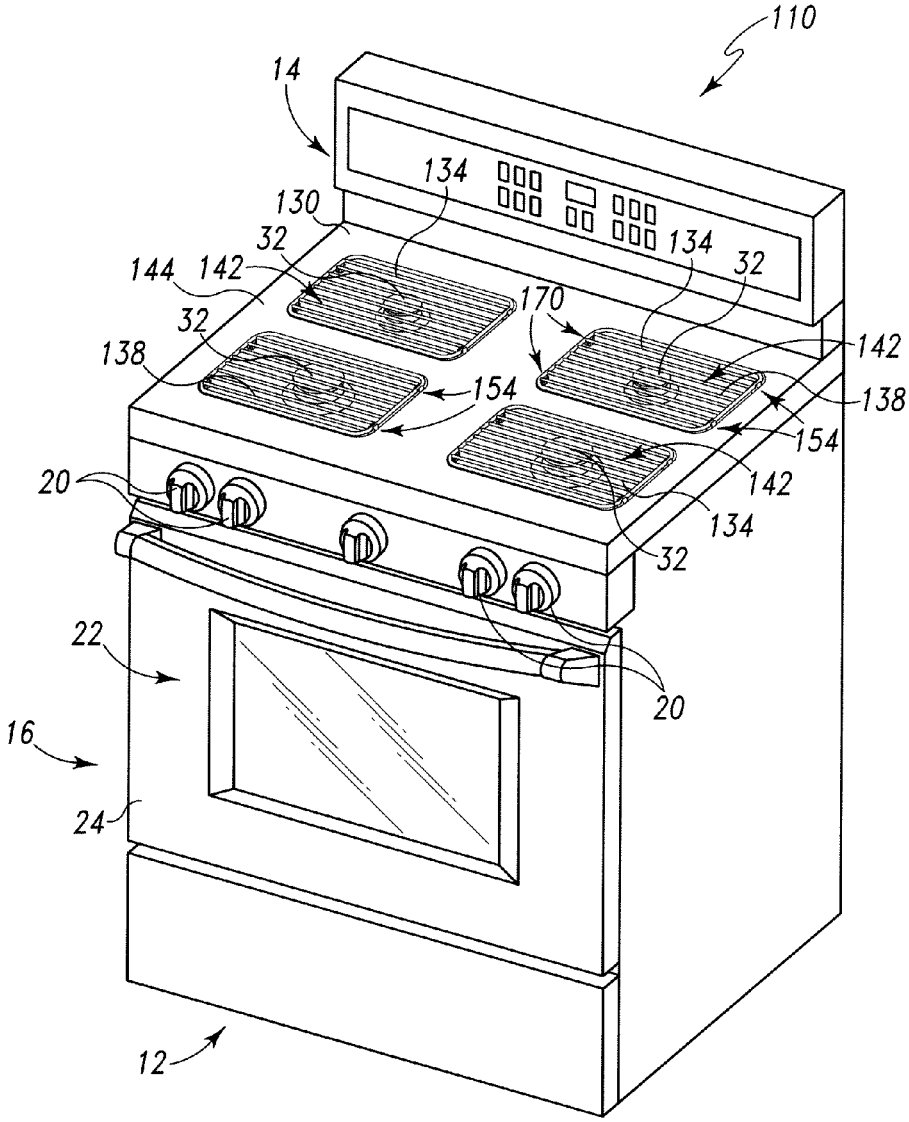
FIG. 5 is a perspective view of another embodiment of a gas cooking range.
Figure 6:
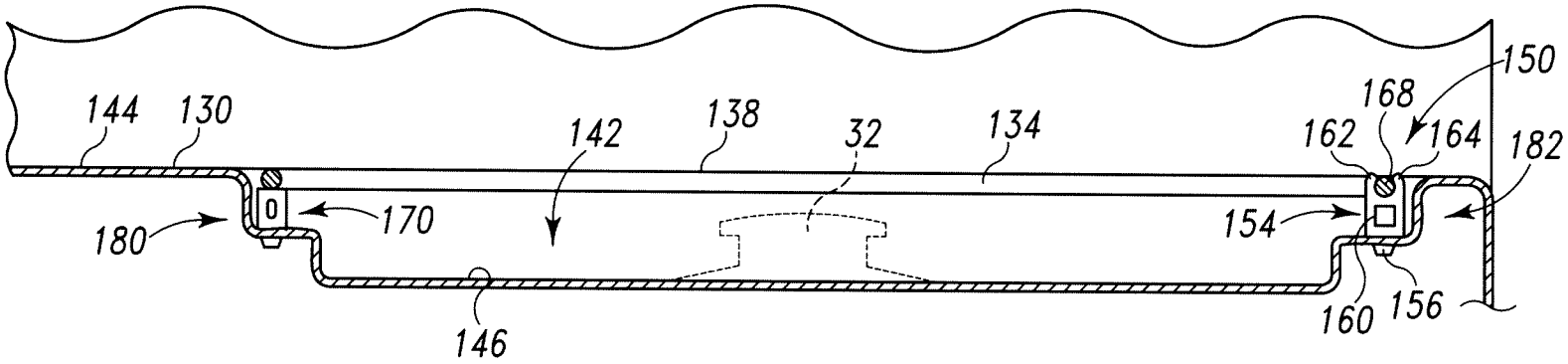
FIG. 6 is a cross-sectional view of a portion of the gas cooking range of FIG. 5.
Figure 7:
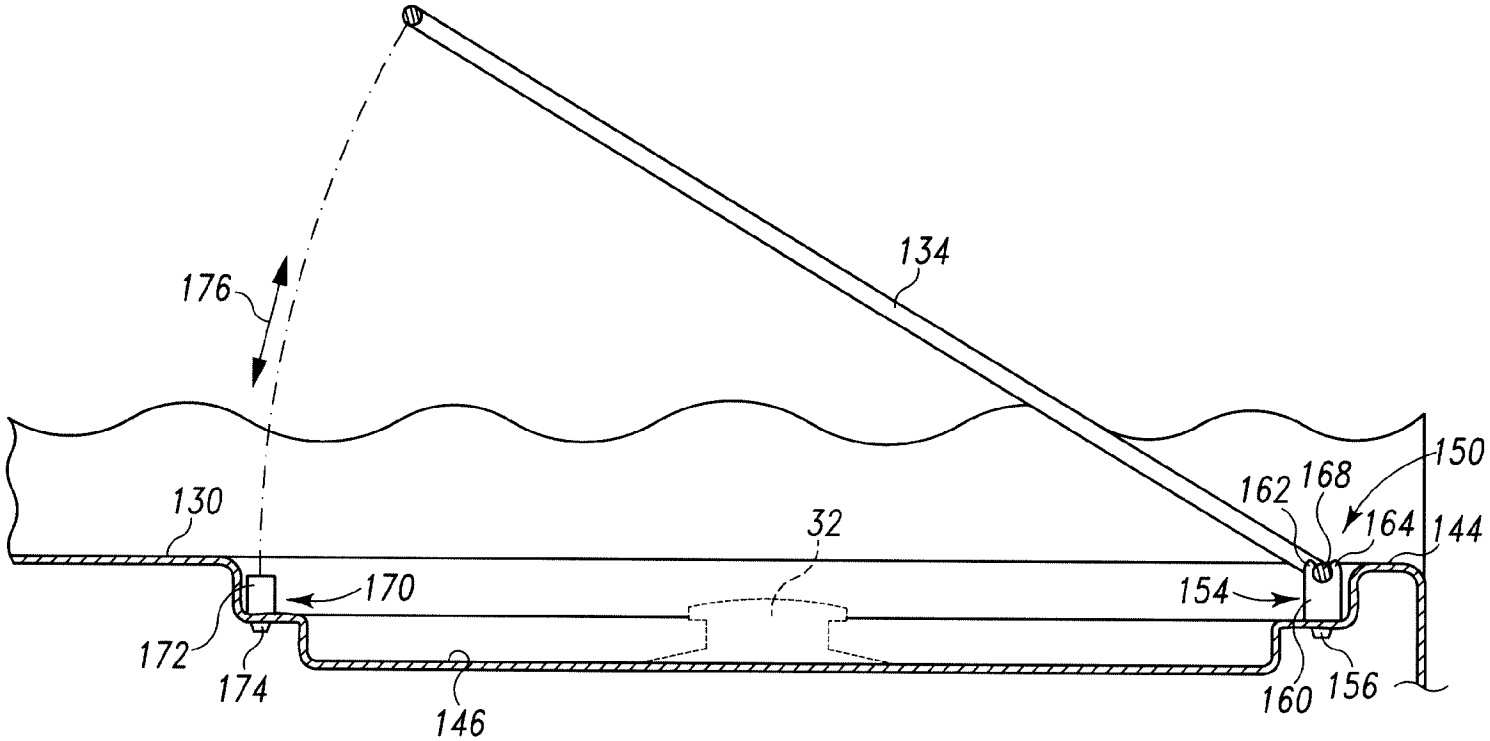
FIG. 7 is a view similar to FIG. 6 with the grate which forms a cooking surface pivoted to expose a gas burner of the range as well as a surface supporting the gas burner.

In another embodiment shown in FIGS. 5-7, a range 110 is similar in most respects to range 10. However, in the illustrative embodiment of FIGS. 5-7, range 110 has a cooktop 130 which includes an upper surface 144 and multiple burner pans 142 each having a recessed surface 146 from which the gas burners 32 extend. Each burner pan 142 is covered by a grate 134 which is supported above the respective gas burner 32 to form a cooking surface 138.

Referring to FIG. 6, the cooktop 130 includes stepped ledges 180 and 182 that are used in supporting the grate 134 above the recessed surface 146. The grate 134 is coupled to a hinge assembly 150 providing for pivotal movement of the grate 134 relative to the cooktop 130. The grate 134 is supported on one side by a yoke 154. The yoke 154 cooperates with a pivot pin 168 secured to allow the grate 134 to be pivoted between its lowered position (as shown in FIG. 6) and a raised position (as shown in FIG. 7) to permit service access to the burner pan and/or burner located under the grate 134. The yoke 154 is secured to the ledge 182 of the cooktop 130. In the illustrative embodiment, the yoke 154 includes a barb 156 which is inserted through a hole (not shown) formed in the cooktop 130 to secure the yoke 154 to the cooktop 130 by a snap-fit connection.

The yoke 154 also includes a body 160 and two arms 162, 164 which extend from the body 160. The arms 162, 164 define a semi-cylindrical inner surface 166 which supports the pivot pin 168 of the grate 134 for pivotal movement. The pivot pin 168 has a cylindrical outer surface that engages with the inner surface 166 formed by the arms 162, 164. The arms 162, 164 are separated by an opening having a dimension smaller than the diameter of the pivot pin 168. The pivot pin 168 is snapped into position between the arms 162, 164 so that the arms 162, 164 retain the pivot pin 168.

The grate 134 is also supported on two support posts 170 which are secured to the cooktop 130. The support posts 170 have a body 172 and a barb 174 which is similar to the barb 156 of yoke 154 and secures the support posts 170 in a similar manner. The grate 134 rests on the support posts 170 in the lowered position shown in FIG. 5 with the weight of the grate 134 maintaining the grate 134 in position on the support posts 170. When access to the burner pan 142 is needed, the grate 134 is lifted as indicated by the arrow 176 in FIG. 7. The grate 134 is rotatable about the center of pivot pin 168 through an angle of about 180° so that the grate 134 contacts the upper surface 144 of the cooktop 130. The cooktop 130 supports the grate 134 while the burner pan 142 and gas burner 32 is cleaned.

The illustrative embodiments of the support posts 170 and yokes 154 are formed of a flexible material. It should be understood that materials which are capable of withstanding the heat of the application may be used within the spirit and scope of this disclosure. For example, the support posts 170 and/or the yokes 154 may be formed of a metal that has an appropriate spring rate to allow the pivot pin 168 to be snap-fit between the arms 162, 164. In addition, the respective barbs 156 and 174 may be omitted with the support posts 170 and/or the yokes 154 secured to the cooktop 130 by a traditional fastener. For example, in some embodiments, the support posts 170 and/or the yokes 154 may be formed to include a threaded rod that extends through the cooktop 130 and is secured to the cooktop with a nut threaded onto the rod from below the cooktop 130.

While the illustrative embodiment disclosed herein are shown as parts of a range assembly, it should be understood that the cooktops 30 and 130 may be utilized as countertop mounted cooktops as is known in the art.

There are a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method apparatus, and system that incorporate one or more of the features of the present invention and fall within the spirit and scope of the present disclosure as defined in the appended claims.

The invention claimed is:

1. A cooking appliance comprising:

a cooktop surface, a first gas burner extending from the cooktop surface, a grate forming a cooking surface for supporting a cooking vessel, and a hinge assembly coupled to the cooktop surface and the grate so as to allow the grate to pivot relative to the cooktop surface between:

a lowered position in which (i) the grate is positioned over the first gas burner and (ii) the cooking surface defines a horizontal plane, and a raised position in which (i) the grate is angled relative to the cooktop surface and the first gas burner and (ii) the cooking surface defines a non-horizontal plane, wherein the hinge assembly further includes a pivot arm having a pivot pin secured to an end thereof, and the grate rests against the pivot arm when the grate is positioned in the raised position.

2. The cooking appliance of claim 1, wherein the hinge assembly comprises:

a yoke, and a pivot pin engaged with the yoke such that there is relative movement between the yoke and the pivot pin during movement of the grate between the lowered and raised positions.

3. The cooking appliance of claim 2, wherein:

the cooking appliance further includes a second gas burner extending from the cooktop surface, and the grate overlies both the first and second burners when the grate is in the lowered position.

4. The cooking appliance of claim 1, wherein the pivot pin defines a pivot axis of the grate that is positioned between, and is generally parallel to, both the cooking surface and the cooktop surface.

5. The cooking appliance of claim 1, wherein:

service access to the first burner is permitted when the grate is positioned in the raised position, and service access to the first burner is prevented when the grate is positioned in the lowered position.

6. A cooking appliance comprising:

a cooktop having a gas burner, a grate forming a cooking surface that is configured to support a cooking vessel at a position above the gas burner, a hinge assembly coupled to the cooktop and the grate so as to allow the grate to pivot relative to the cooktop between a lowered position in which the cooking surface defines a horizontal plane and a raised position in which the cooking surface defines a non-horizontal plane, and a support post secured to a first side of the grate, wherein:

the support post supports the first side of the grate when the grate is positioned in the lowered position, and the hinge assembly is secured to a second, opposite side of the grate so as to support the second side of the grate when the grate is positioned in the lowered position.

7. The cooking appliance of claim 6, wherein the hinge assembly comprises:

a yoke secured to the grate, a pivot pin secured to the cooktop, and the pivot pin is received within the yoke so as to allow the yoke to pivot relative to the pivot pin.

8. The cooking appliance of claim 6, wherein the hinge assembly comprises:

a yoke secured to the cooktop, a pivot pin secured to the grate, and the pivot pin is received within the yoke so as to allow the pin to pivot relative to the yoke.

9. A cooking appliance comprising:

a cooktop having a gas burner, a grate forming a cooking surface that is configured to support a cooking vessel at a position above the gas burner, a hinge assembly coupled to the cooktop and the grate so as to allow the grate to pivot relative to the cooktop between a lowered position in which the cooking surface defines a horizontal plane and a raised position in which the cooking surface defines a non-horizontal plane, and a support post secured to the cooktop, wherein:

the hinge assembly is secured to a first side of the grate so as to support the first side of the grate when the grate is positioned in the lowered position, and the support post supports a second, opposite side of the grate when the grate is positioned in the lowered position.

10. The cooking appliance of claim 6, wherein:

the cooktop comprises a burner pan, and the gas burner is positioned in the burner pan.

11. The cooking appliance of claim 6, wherein:

service access to the burner is permitted when the grate is positioned in the raised position, and service access to the burner is prevented when the grate is positioned in the lowered position.

12. A cooking appliance comprising:

a cooktop having a first gas burner positioned proximate to the front of the cook top and a second gas burner positioned proximate to the rear of the cooktop, a grate having a frame with a number of tines extending inwardly from the frame, the number of tines forming (i) a first cooking surface configured to support a first cooking vessel above the first gas burner, and (ii) a second cooking surface configured to support a second cooking vessel above the second gas burner, a hinge assembly coupled to the cooktop and the grate so as to allow the grate to pivot relative to the cooktop between:

a lowered position in which (i) the grate is positioned over the first gas burner and the second gas burner and (ii) the first cooking surface and the second cooking surface define a horizontal plane, and a raised position in which (i) the grate is angled relative to the cooktop, the first gas burner, and the second gas burner, and (ii) the first cooking surface and the second cooking surface define a non-horizontal plane, and a support post secured to a first side of the grate, wherein:

the support post supports the first side of the grate when the grate is positioned in the lowered position, and the hinge assembly is secured to a second, opposite side of the grate so as to support the second side of the grate when the grate is positioned in the lowered position.

13. The cooking appliance of claim 12, wherein the hinge assembly comprises:

a yoke secured to the grate, a pivot pin secured to the cooktop, and the pivot pin is received within the yoke so as to allow the yoke to pivot relative to the pivot pin.

14. The cooking appliance of claim 12, wherein the hinge assembly comprises:

a yoke secured to the cooktop, a pivot pin secured to the grate, and the pivot pin is received within the yoke so as to allow the pin to pivot relative to the yoke.

15. A cooking appliance comprising:

a cooktop having a first gas burner positioned proximate to the front of the cook top and a second gas burner positioned proximate to the rear of the cooktop, a grate having a frame with a number of tines extending inwardly from the frame, the number of tines forming (i) a first cooking surface configured to support a first cooking vessel above the first gas burner, and (ii) a second cooking surface configured to support a second cooking vessel above the second gas burner, a hinge assembly coupled to the cooktop and the grate so as to allow the grate to pivot relative to the cooktop between:

a lowered position in which (i) the grate is positioned over the first gas burner and the second gas burner and (ii) the first cooking surface and the second cooking surface define a horizontal plane, and a raised position in which (i) the grate is angled relative to the cooktop, the first as burner, and the second as burner, and (ii) the first cooking surface, and the second cooking surface define a non-horizontal plane, and a support post secured to the cooktop, wherein:

the hinge assembly is secured to a first side of the grate so as to support the first side of the grate when the grate is positioned in the lowered position, and the support post supports a second, opposite side of the grate when the grate is positioned in the lowered position.

16. The cooking appliance of claim 12, wherein:

the cooktop comprises a burner pan, and both the first gas burner and the second gas burner are positioned in the burner pan.

17. The cooking appliance of claim 12, wherein:

service access to both the first burner and the second burner is permitted when the grate is positioned in the raised position, and service access to both the first burner and the second burner is prevented when the grate is positioned in the lowered position.

* * * * *